US009140245B2

(12) United States Patent
Nakai et al.

(10) Patent No.: US 9,140,245 B2
(45) Date of Patent: Sep. 22, 2015

(54) ELECTROMAGNETIC PUMP

(75) Inventors: Masaya Nakai, Tokoname (JP); Kazuhiko Kato, Kariya (JP)

(73) Assignee: AISIN AW CO., LTD., Anjo (JP)

( * ) Notice: Subject to any disclaimer, the term of this patent is extended or adjusted under 35 U.S.C. 154(b) by 369 days.

(21) Appl. No.: 13/413,204

(22) Filed: Mar. 6, 2012

(65) Prior Publication Data

US 2012/0244013 A1 Sep. 27, 2012

(30) Foreign Application Priority Data

Mar. 25, 2011 (JP) ..... 2011-068806

(51) Int. Cl.
*F04B 17/04* (2006.01)

(52) U.S. Cl.
CPC ..... *F04B 17/042* (2013.01); *F04B 17/04* (2013.01); *F04B 17/044* (2013.01); *F04B 17/048* (2013.01)

(58) Field of Classification Search
CPC ..... F04B 17/00; F04B 17/03; F04B 17/04; F04B 17/042; F04B 17/044; F04B 35/045
USPC ..... 417/410.1, 416, 417, 454
See application file for complete search history.

(56) References Cited

U.S. PATENT DOCUMENTS 2,362,139 A * 11/1944 Kelly ..... 417/454
3,543,682 A * 12/1970 Frederick ..... 101/366
3,939,755 A * 2/1976 Tabor ..... 91/224
4,778,357 A 10/1988 Arai et al.
5,797,733 A * 8/1998 Falk et al. ..... 417/416
6,126,418 A * 10/2000 Sinnl ..... 417/470
6,224,352 B1 * 5/2001 Hauser et al. ..... 417/313
6,589,032 B2 * 7/2003 Summers et al. ..... 417/549
6,648,614 B1 * 11/2003 Hinz et al. ..... 417/470
7,094,041 B2 8/2006 Hashimoto et al.

(Continued)

FOREIGN PATENT DOCUMENTS

DE 1653354 A1 * 8/1971
DE 4316986 A1 * 11/1994

(Continued)

OTHER PUBLICATIONS

13413204—Translation of DE 43 16 986 A1, Desc and clms accessed Dec. 29, 2014.*

(Continued)

*Primary Examiner* — Devon Kramer
*Assistant Examiner* — Jon Hoffmann
(74) *Attorney, Agent, or Firm* — Oliff PLC

(57) ABSTRACT

An electromagnetic pump includes a cylinder with a stepped inner diameter with first and second inner diameters. A piston inside the cylinder, with a stepped outer diameter including first and second outer diameters slidable on the respective inner diameters, defines first and second fluid chambers. Reciprocal movement of the piston produces a greater change in volume in the first chamber than the second chamber. An electromagnetic portion moves the piston to decrease the volume of the first chamber and increase the volume of the second chamber. A biasing member moves the piston to increase the volume of the first chamber and decrease the volume of the second chamber. A first valve allows fluid to flow to the first chamber and prohibits reverse flow. A second valve embedded in the piston allows fluid to flow from the first chamber to the second chamber and prohibits reverse flow.

1 Claim, 2 Drawing Sheets

(56) References Cited

U.S. PATENT DOCUMENTS

| | | | | |
|---|---|---|---|---|
| 7,690,899 | B2 * | 4/2010 | Harada | 417/254 |
| 2001/0048884 | A1 * | 12/2001 | Siegel et al. | 417/470 |
| 2002/0110460 | A1 * | 8/2002 | Kominami | 417/214 |

FOREIGN PATENT DOCUMENTS

| | | | |
|---|---|---|---|
| DE | 19743186 | A1 * | 4/1999 |
| JP | A-56-060879 | | 5/1981 |
| JP | A-2011-021593 | | 2/2011 |
| WO | WO 02/33259 | A1 | 4/2002 |
| WO | WO 2010/146952 | A1 | 12/2010 |
| WO | WO 2010146952 | A1 * | 12/2010 |

OTHER PUBLICATIONS

Translation of DE 1653354 A1, Bierling, Hans-Joachim.*
Translation of DE 19743186 A1, Trompka, Andreas.*
International Search Report issued in Application No. PCT/JP2012/054994; Dated May 29, 2012 (With Translation).

* cited by examiner

ELECTROMAGNETIC PUMP

INCORPORATION BY REFERENCE

The disclosure of Japanese Patent Application No. 2011-068806 filed on Mar. 25, 2011 including the specification, drawings and abstract is incorporated herein by reference in its entirety.

BACKGROUND OF THE INVENTION

The present invention relates to an electromagnetic pump.

Description of the Related Art

A past example of this type of electromagnetic pump (e.g., see Japanese Patent Application Publication No. JP-A-2011-21593) includes: a cylinder; a piston that reciprocates inside the cylinder; a solenoid portion that forwardly moves the piston; a spring that backwardly moves the piston; an intake check valve; and a discharge check valve. A sliding surface on which a piston body slides and a sliding surface on which a shaft portion of the piston slides are formed in a stepped manner on an inner wall of the cylinder. A first pump chamber is formed by the inner wall of the cylinder and a front surface of the piston body. A second pump chamber is formed by a back surface of the piston body and the stepped portion of the cylinder. In this electromagnetic pump, the first pump chamber is formed such that a change in volume therein during the reciprocating movement of the piston is greater than a change in volume in the second pump chamber. When the piston forwardly moves by the electromagnetic force of the solenoid portion, the volume of the first pump chamber decreases and the volume of the second pump increases. This causes the intake check valve to close, and sends hydraulic oil from the first pump chamber through the discharge check valve to the second pump chamber, thus generating hydraulic pressure in the second pump chamber. When the electromagnetic force of the solenoid portion is turned off and the piston backwardly moves by the biasing force of the spring, the volume of the first pump chamber increases and the volume of the second pump chamber decreases. This causes hydraulic oil to be suctioned from a supply source through the intake check valve into the first pump chamber, and pressurizes the hydraulic oil inside the second pump chamber with the discharge check valve in a closed state, thus generating hydraulic pressure. Here, the discharge check valve is embedded in the piston as interposed between the first pump chamber and the second pump chamber.

SUMMARY OF THE INVENTION

In the electromagnetic pump described above, a check valve is embedded in the piston so there is no need to separately provide a check valve in the valve body. However, in such an electromagnetic pump, a space for providing the check valve must be secured inside the piston. As a consequence, this type of electromagnetic pump may have a longer axial length than a type in which a check valve is not embedded in the piston, thus increasing the size of the pump.

The present invention downsizes an electromagnetic pump.

The electromagnetic pump of the present invention employs the following to achieve the above.

An electromagnetic pump according to the present invention includes: a cylinder that is formed with a stepped inner diameter portion that includes a first inner diameter portion and a second inner diameter portion with a diameter smaller than that of the first inner diameter portion; a piston that is accommodated inside the cylinder, is formed with a stepped outer diameter portion that includes a first outer diameter portion slidable on the first inner diameter portion of the cylinder and a second outer diameter portion slidable on the second inner diameter portion of the cylinder, defines a first fluid chamber on an opposite side of the first outer diameter portion from the second outer diameter portion and a second fluid chamber on the second outer diameter portion side of the first outer diameter portion, and is formed such that a reciprocal movement of the piston is accompanied by a greater change in volume in the first fluid chamber than a change in volume in the second fluid chamber; an electromagnetic portion that forwardly moves the piston in a manner that decreases the volume of the first fluid chamber and increases the volume of the second fluid chamber; a biasing member that backwardly moves the piston in a manner that increases the volume of the first fluid chamber and decreases the volume of the second fluid chamber; a first on-off valve that allows a hydraulic fluid to move from a supply source to the first fluid chamber and prohibits reverse movement of the hydraulic fluid; and a second on-off valve that is embedded in the piston and interposed between the first fluid chamber and the second fluid chamber, and allows the hydraulic fluid to move from the first fluid chamber to the second fluid chamber and prohibits reverse movement of the hydraulic fluid. Formed in the piston are a bottomed hollow portion that opens to a first fluid chamber side of the first outer diameter portion and accommodates the second on-off valve, and a communication hole that provides communication between the hollow portion and the second fluid chamber. The hollow portion extends from the first outer diameter portion to partway inside the second outer diameter portion.

According to the present invention, the electromagnetic pump includes: a cylinder that is formed with a stepped inner diameter portion that includes a first inner diameter portion and a second inner diameter portion with a diameter smaller than that of the first inner diameter portion; a piston that is accommodated inside the cylinder, is formed with a stepped outer diameter portion that includes a first outer diameter portion slidable on the first inner diameter portion of the cylinder and a second outer diameter portion slidable on the second inner diameter portion of the cylinder, defines a first fluid chamber on an opposite side of the first outer diameter portion from the second outer diameter portion and a second fluid chamber on the second outer diameter portion side of the first outer diameter portion, and is formed such that a reciprocal movement of the piston is accompanied by a greater change in volume in the first fluid chamber than a change in volume in the second fluid chamber; an electromagnetic portion that forwardly moves the piston in a manner that decreases the volume of the first fluid chamber and increases the volume of the second fluid chamber; a biasing member that backwardly moves the piston in a manner that increases the volume of the first fluid chamber and decreases the volume of the second fluid chamber; a first on-off valve that allows a hydraulic fluid to move from a supply source to the first fluid chamber and prohibits reverse movement of the hydraulic fluid; and a second on-off valve that is embedded in the piston and interposed between the first fluid chamber and the second fluid chamber, and allows the hydraulic fluid to move from the first fluid chamber to the second fluid chamber and prohibits reverse movement of the hydraulic fluid. Formed in the piston are a bottomed hollow portion that opens to a first fluid chamber side of the first outer diameter portion and accommodates the second on-off valve, and a communication hole that provides communication between the hollow portion and the second fluid chamber. The hollow portion extends from the first outer diameter portion to partway inside the second outer diameter portion. Thus, the second on-off valve can be embedded in the piston even if the piston has a relatively shortened axial length. Therefore, the type of electromagnetic pump with the second on-off valve embedded can be further downsized.

In the electromagnetic pump of the present invention described above, the second on-off valve may include a ball, an opening member that forms an opening portion with an inner diameter smaller than an outer diameter of the ball on the first fluid chamber side of the first outer diameter portion, and a second biasing member that presses the ball against the opening portion, wherein the ball, the opening member, and the second biasing member are disposed in the hollow portion in order of the second biasing member, the ball, and the opening member.

Further, in the electromagnetic pump of the present invention, the communication hole may be a plurality of through holes that runs through the second outer diameter portion in the radial direction at a predetermined angular interval. Thus, simply performing relatively easy processing enables the hydraulic fluid to smoothly flow from the first fluid chamber to the second fluid chamber.

DETAILED DESCRIPTION OF THE EMBODIMENT

Next, an embodiment of the present invention will be described.

Figure 1:
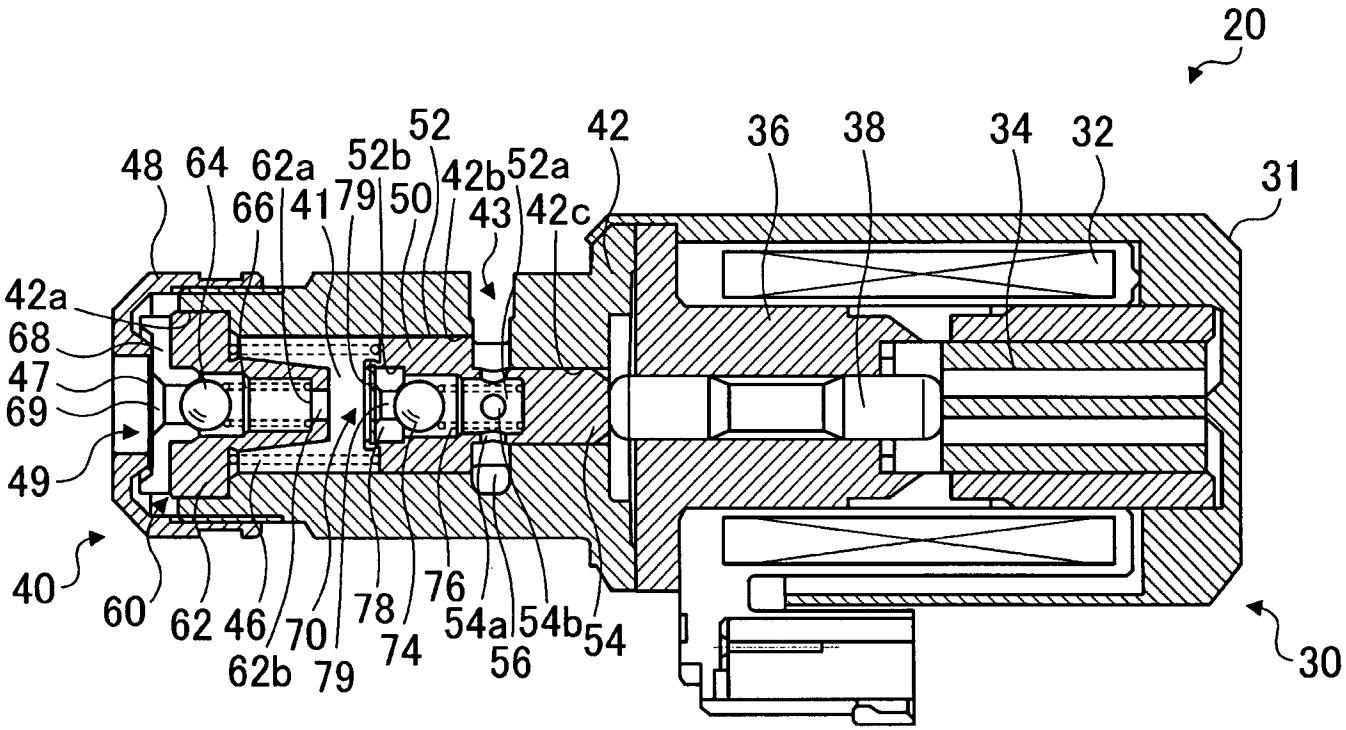
FIG. 1 is a structural diagram that shows the overall configuration of an electromagnetic pump 20 as an embodiment of the present invention.

FIG. 1 is a structural diagram that shows the overall configuration of an electromagnetic pump 20 as an embodiment of the present invention. As shown in the figure, the electromagnetic pump 20 of the embodiment is configured as a piston pump that reciprocates a piston 50 to pressure-feed a hydraulic oil. The electromagnetic pump 20 also includes a solenoid portion 30 that generates an electromagnetic force, and a pump portion 40 that operates by the electromagnetic force of the solenoid portion 30. The electromagnetic pump 20 is incorporated into a valve body as a portion of a hydraulic circuit for turning on and off a clutch or a brake provided in an automatic transmission mounted in an automobile, for example.

The solenoid portion 30 has a case 31 as a bottomed cylinder member on which an electromagnetic coil 32, a plunger 34 as a movable element, and a core 36 as a fixed element are disposed. Applying a current to the electromagnetic coil 32 forms a magnetic circuit in which magnetic flux circles the case 31, the plunger 34, and the core 36, whereby the plunger 34 is suctioned and presses out a shaft 38 that is in contact with a proximal end of the plunger 34.

The pump portion 40 includes: a hollow cylindrical cylinder 42 that is joined to the solenoid portion 30; the piston 50 that is slidably disposed inside the cylinder 42, and has a base end surface that is coaxial with and contacts a proximal end of the shaft 38 of the solenoid portion 30; a spring 46 that contacts a proximal end of the piston 50, and applies a biasing force in a direction opposite from the direction in which the solenoid portion 30 applies an electromagnetic force; an intake check valve 60 that supports the spring 46 from a side opposite from the proximal end surface of the piston 50, and allows the hydraulic oil to flow in the suctioning direction toward a pump chamber 41 and prohibits the hydraulic oil from flowing in the reverse direction; a discharge check valve 70 that is embedded in the piston 50, and allows the hydraulic oil to flow in the discharging direction from the pump chamber 41 and prohibits the hydraulic oil from flowing in the reverse direction; a strainer 47 that is disposed upstream of the intake check valve 60, and catches foreign matter included in the hydraulic oil that is suctioned toward the pump chamber 41; and a cylinder cover 48 that covers an opening portion 42*a* on a side of the cylinder 42 opposite from the solenoid portion 30 with the piston 50, the discharge check valve 70, the spring 46, the intake check valve 60, and the strainer 47 incorporated in that order from the opening portion 42*a*. Spiral grooves are formed in the circumferential direction on an inner circumferential surface of the cylinder cover 48 and an outer circumferential surface of the opening portion 42*a* of the cylinder 42. Threadedly fastening the cylinder cover 48 with the opening portion 42*a* of the cylinder 42 attaches the cylinder cover 48 to the opening portion 42*a* of the cylinder 42. Note that, in the pump portion 40, an intake port 49 for suctioning the hydraulic oil is formed at an axial center of the cylinder cover 48, and a discharge port 43 for discharging the suctioned hydraulic oil is formed in a side surface of the cylinder 42.

The piston 50 is formed from a cylindrical piston body 52, and a cylindrical shaft portion 54 that has an outer diameter smaller than the piston body 52 and an end surface that contacts the proximal end of the shaft 38 of the solenoid portion 30. The piston 50 moves in association with the shaft 38 of the solenoid portion 30 and reciprocates inside the cylinder 42.

The intake check valve 60 includes: a valve body 62 that is fitted by insertion to an inner circumferential surface of the opening portion 42*a* of the cylinder 42, formed therein with a bottomed hollow portion 62*a*, and formed with a center hole 62*b* that provides communication between the hollow portion 62*a* and the pump chamber 41 at an axial center of the bottom of the hollow portion 62*a*; a ball 64; a spring 66 that applies a biasing force to the ball 64; and a plug 68 that is fitted by insertion to an inner circumferential surface of the hollow portion 62*a* with the ball 64 and the spring 66 incorporated into the hollow portion 62*a* of the valve body 62. The plug 68 is formed as a ring-shaped member that includes a center hole 69 with an inner diameter smaller than the outer diameter of the ball 64. The ball 64 biased by the spring 66 is pressed against the center hole 69.

When a differential pressure (P1-P2) between a pressure P1 on the intake port 49 side and a pressure P2 on the pump chamber 41 side is equal to or greater than a predetermined pressure that overcomes the biasing force of the spring 66, the spring 66 contracts and causes the ball 64 to separate from the center hole 69 of the plug 68, thereby opening the intake check valve 60. When the differential pressure (P1-P2) described above is less than the predetermined pressure, the spring 66 elongates and causes the ball 64 to press against the center hole 69 of the plug 68, thereby blocking the center hole 69 and closing the intake check valve 60.

The discharge check valve 70 includes: a ball 74, a spring 76 that applies a biasing force to the ball 74; and a plug 78 as a ring-shaped member that has a center hole 79 with an inner diameter smaller than the outer diameter of the ball 74. The spring 76, the ball 74, and the plug 78 are incorporated in that order from an opening portion 52*b* of the hollow portion 52*a* of the piston 50, and fixed by a snap ring 79.

When a differential pressure (P2-P3) between the pressure P2 on the pump chamber 41 side and a pressure P3 on the discharge port 43 side is equal to or greater than a predetermined pressure that overcomes the biasing force of the spring 76, the spring 76 contracts and causes the ball 74 to separate from the center hole 79 of the plug 78, thereby opening the discharge check valve 70. When the differential pressure (P2-P3) described above is less than the predetermined pressure, the spring 76 elongates and causes the ball 74 to press against the center hole 79 of the plug 78, thereby blocking the center hole 79 and closing the discharge check valve 70.

Figure 2:
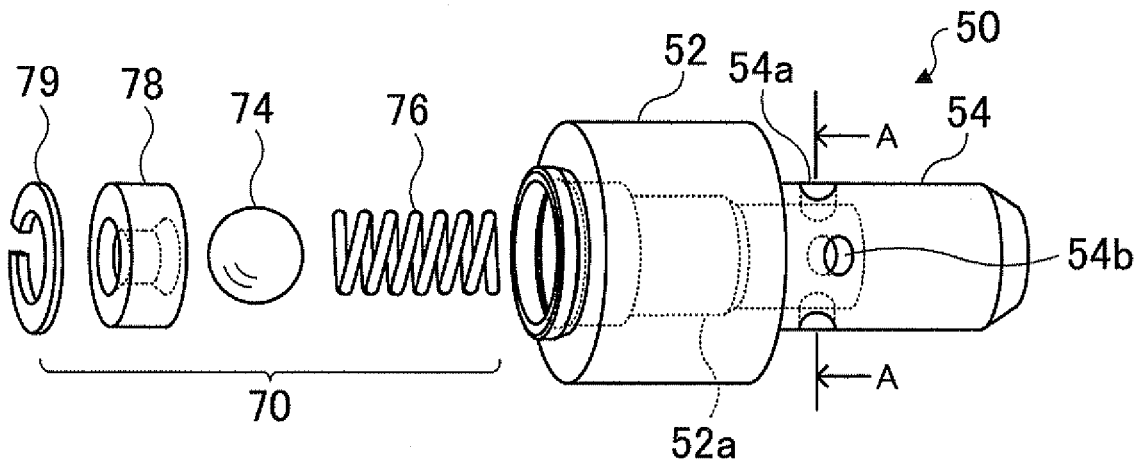
FIG. 2 is an exploded perspective view of a piston 50 and a discharge check valve 70.
Figure 3:
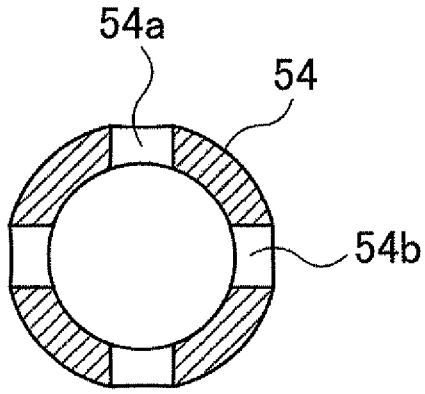
FIG. 3 is a cross-sectional view that shows a cross section A-A of the piston 50 in FIG. 2.

FIG. 2 is an exploded perspective view of the piston 50 and the discharge check valve 70. FIG. 3 is a cross-sectional view that shows a cross section A-A of the piston 50 in FIG. 2. As shown in FIG. 2, a cylindrical, bottomed hollow portion 52*a* that can accommodate the discharge check valve 70 is formed at an axial center of the piston 50. The hollow portion 52*a* of the piston 50 runs from a proximal end surface of the piston 50 to inside the piston body 52, and extends to partway inside the shaft portion 54. In addition, as shown in FIG. 3, two through holes 54*a*, 54*b* that intersect at a 90-degree angle in the radial direction are formed in the shaft portion 54. The discharge port 43 is formed around the shaft portion 54 (see FIG. 1), and the hollow portion 52*a* of the piston 50 is provided in communication with the discharge port 43 through the two through holes 54*a*, 54*b*.

Thus, the hollow portion 52*a* of the piston 50 runs from the proximal end surface of the piston 50 through to inside the piston body 52, and extends to partway inside the shaft portion 54. Therefore, the discharge check valve 70 can still be embedded in the piston 50 even if the axial length of the piston 50 is set to a minimum required length, e.g., shortened as much as possible within a range that ensures the hydraulic oil does not leak from a gap between the sliding surfaces of the piston 50 and the cylinder 42. In addition, simply forming the through holes 54*a*, 54*b* in the shaft portion 54 in the radial direction can provide communication between the hollow portion 52*a* of the piston 50 and the discharge port 43, which facilitates processing.

In the cylinder 42, the pump chamber 41 is formed by a space that is surrounded by an inner wall 42*b* on which the piston body 52 slides, a surface of the piston body 52 on the spring 46 side, and a surface of the valve body 62 of the intake check valve 60 on the spring 46 side. In the pump chamber 41, when the piston 50 moves by the biasing force of the spring 46, the volume inside the pump chamber 41 increases and causes the intake check valve 60 to open and the discharge check valve 70 to close, thereby suctioning the hydraulic oil through the intake port 49. When the piston 50 moves by the electromagnetic force of the solenoid portion 30, the volume inside the pump chamber 41 decreases and causes the intake check valve 60 to close and the discharge check valve 70 to open, thereby discharging the suctioned hydraulic oil through the discharge port 43.

Also, the cylinder 42 is formed with the inner wall 42*b* on which the piston body 52 slides, and an inner wall 42*c* on which the shaft portion 54 slides. The inner wall 42*b* and the inner wall 42*c* are arranged in a stepped configuration, and the discharge port 43 is formed at a stepped section thereof. The stepped section forms a space that is surrounded by a ring-shaped surface of the stepped section between the piston body 52 and the shaft portion 54, and an outer circumferential surface of the shaft portion 54. Because the space is formed on the opposite side of the piston body 52 from the pump chamber 41, the volume of the space decreases when the volume of the pump chamber 41 increases, and the volume of the space increases when the volume of the pump chamber 41 decreases. At such times, the change in the volume of the space is smaller than the change in the volume of the pump chamber 41, because the surface area (pressure-receiving surface area) of the piston body 52 that receives pressure from the pump chamber 41 side is larger than the surface area (pressure-receiving surface area) of the piston body 52 that receives pressure from the discharge port 43 side. Therefore, the space functions as a second pump chamber 56. In other words, when the piston 50 moves by the electromagnetic force of the solenoid portion 30, an amount of hydraulic oil that corresponds to the difference in the amount that the volume of the pump chamber 41 decreases and the amount that the volume of the second pump chamber 56 increases is delivered from the pump chamber 41 to the second pump chamber 56 via the discharge check valve 70 and discharged through the discharge port 43. When the piston 50 moves by the biasing force of the spring 46, an amount of hydraulic oil that corresponds to the amount that the volume of the pump chamber 41 increases is suctioned through the intake port 49 into the pump chamber 41 via the intake check valve 60, while an amount of hydraulic oil that corresponds to the amount that the volume of the second pump chamber 56 decreases is discharged from the second pump chamber 56 through the discharge port 43. Accordingly, one reciprocal movement of the piston 50 discharges the hydraulic oil twice from the discharge port 43, which can reduce discharge variation and improve discharge performance.

According to the electromagnetic pump 20 of the embodiment described above, the hollow portion 52*a* is used to embed the discharge check valve 70 in the piston 50 that is formed from the piston body 52 and the shaft portion 54. The hollow portion 52*a* runs in an axially central manner from the proximal end surface of the piston 50 through to inside the piston body 52, and extends to partway inside the shaft portion 54. Therefore, the discharge check valve 70 can still be embedded in the piston 50 even if the axial length of the piston 50 is set to a minimum required length. Moreover, simply forming the through holes 54*a*, 54*b* in the shaft portion 54 in the radial direction can provide communication between the hollow portion 52*a* of the piston 50 and the discharge port 43, which facilitates processing.

In the electromagnetic pump 20 of the embodiment, the intake check valve 60 is embedded in the cylinder 42. However, the present invention is not limited to this example, and the intake check valve 60 may be disposed outside the cylinder 42.

The electromagnetic pump 20 of the embodiment is used to supply a hydraulic pressure for turning on and off a clutch or a brake of an automatic transmission mounted in an automobile. However, the present invention is not limited to this example, and the electromagnetic pump 20 may be used in any system that transports fuel, transports lubricating fluid, or the like.

Here, the correspondence relation will be described between main elements in the embodiment and main elements of the invention as listed in the Summary of the Invention. In the embodiment, the cylinder 42 corresponds to a "cylinder"; the piston 50 to a "piston"; the solenoid portion 30 to an "electromagnetic portion"; the spring 46 to a "biasing member"; the intake check valve 60 to a "first on-off valve"; and the discharge check valve 70 to a "second on-off valve". The ball 74 corresponds to a "ball"; the plug 78 to an "opening member"; and the spring 76 to a "second biasing member". Note that with regard to the correspondence relation between the main elements of the embodiment and the main elements of the invention as listed in the Summary of the Invention, the embodiment is only an example for giving a specific description of a best mode for carrying out the invention explained in the Summary of the Invention. This correspondence relation does not limit the elements of the invention as described in the Summary of the Invention. In other words, any interpretation of the invention described in the Summary of the Invention shall be based on the description therein; the embodiment is merely one specific example of the invention described in the Summary of the Invention.

The above embodiment was used to describe a mode for carrying out the present invention. However, the present invention is not particularly limited to such an example, and may obviously be carried out in various embodiments without departing from the scope of the present invention.

The present invention may be used in the manufacturing industry of an electromagnetic pump, and the like.

What is claimed is:

1. An electromagnetic pump comprising:

a cylinder that is formed with a stepped inner diameter portion that includes a first inner diameter portion and a second inner diameter portion with a diameter smaller than that of the first inner diameter portion;

a piston that is accommodated inside the cylinder, is formed with a stepped outer diameter portion that includes a first outer diameter portion slidable within the first inner diameter portion of the cylinder and a second outer diameter portion with a substantially constant diameter along its axial length and slidable within the second inner diameter portion of the cylinder, defines a first fluid chamber on an opposite side of the first outer diameter portion from the second outer diameter portion and a second fluid chamber on the second outer diameter portion side of the first outer diameter portion, and is formed such that a reciprocal movement of the piston is accompanied by a greater change in volume in the first fluid chamber than a change in volume in the second fluid chamber;

an electromagnetic portion that forwardly moves the piston in a manner that decreases the volume of the first fluid chamber and increases the volume of the second fluid chamber;

a biasing member that backwardly moves the piston in a manner that increases the volume of the first fluid chamber and decreases the volume of the second fluid chamber;

a first on-off valve that allows a hydraulic fluid to move from a supply source to the first fluid chamber and prohibits reverse movement of the hydraulic fluid; and a second on-off valve that is embedded in the piston and interposed between the first fluid chamber and the second fluid chamber, and allows the hydraulic fluid to move from the first fluid chamber to the second fluid chamber and prohibits reverse movement of the hydraulic fluid, wherein formed in the piston are a bottomed hollow portion that opens to a first fluid chamber side of the first outer diameter portion and accommodates the second on-off valve, and a plurality of through holes that runs through the second outer diameter portion in the radial direction at a predetermined angular interval and that provides communication between the hollow portion and the second fluid chamber, the hollow portion extends from the first outer diameter portion to partway inside the second outer diameter portion, the second on-off valve includes a ball and a second biasing member that presses the ball toward the first fluid chamber with the second biasing member supported by a bottom portion of the hollow portion, the plurality of through holes are closer to the bottom portion of the hollow portion than the ball of the second on-off valve, the second on-off valve includes the ball, an opening member that forms an opening portion with an inner diameter smaller than an outer diameter of the ball on the first fluid chamber side of the first outer diameter portion, and the second biasing member that presses the ball against the opening portion, wherein the ball, the opening member, and the second biasing member are disposed in the hollow portion in order of the second biasing member, the ball, and the opening member, and the plurality of through holes is disposed on an outer circumferential side of the second biasing member and axially overlaps the second biasing member in the second outer diameter portion.

* * * * *